United States Patent [19]

Spitsbergen et al.

[11] 4,012,674

[45] Mar. 15, 1977

[54] DUAL MOTOR WEB MATERIAL TRANSPORT SYSTEM

[75] Inventors: Merlin D. Spitsbergen; James G. Hughes, both of Rochester, Mich.

[73] Assignee: Computer Peripherals, Inc., Rochester, Mich.

[22] Filed: Apr. 7, 1975

[21] Appl. No.: 565,593

[52] U.S. Cl. ..... 318/7; 318/98; 318/113

[51] Int. Cl.[2] ..... B65H 77/00

[58] Field of Search ..... 318/7, 113, 71, 80, 318/98

[56] References Cited

UNITED STATES PATENTS

| | | | |
|---|---|---|---|
| 3,501,682 | 3/1970 | Jacoby | 318/7 |
| 3,704,401 | 11/1972 | Miller | 318/7 |
| 3,912,990 | 10/1975 | Kuhnlein | 318/7 |
| 3,913,866 | 10/1975 | Hankins | 318/7 |
| 3,921,043 | 11/1975 | Luzio | 318/7 |
| 3,926,513 | 12/1975 | Silver et al. | 318/7 |

*Primary Examiner*—B. Dobeck
*Attorney, Agent, or Firm*—J. T. Cavender; Wilbert Hawk, Jr.; Jeffrey P. Morris

[57] ABSTRACT

A ribbon drive and motor control system in which the instantaneous speed and torque output of a pair of motors are controlled interdependently to bidirectionally transfer ribbon or other web material between a pair of storage reels mechanically coupled to the motors at a uniform ribbon velocity and tension. The motors are electrically excited in series to rotate in the same direction with the back electromotive force of one motor being used to vary the instantaneous excitation voltage applied to the other motor, while drag from said other motor is imparted to the ribbon to control the speed of the first motor. Compensation for variation of the radii of ribbon on the reels during operation is accomplished automatically by variation of motor torque and velocity to minimize variation in ribbon tension and ribbon velocity. A bridge switch actuated by signals initiated by electrical contacts near the ends of the ribbon causes the motors to reverse direction. The system results in longer ribbon life, improved tracking and increased speed capability in an impact printer without complex servo controls.

24 Claims, 4 Drawing Figures

MOTOR RPM
60
50
40
30
20
10
0
M21
24 V
M12
18 V
M11
12 V
M22
6 V
0
100
200
300
MOTOR TORQUE (INCH-OZ)

MOTOR CURRENT
.60
.50
.40
.30
.20
.10
0
24 V
18 V
12 V
6 V
0
100
200
300
MOTOR TORQUE (INCH-OZ)

DUAL MOTOR WEB MATERIAL TRANSPORT SYSTEM

BACKGROUND OF THE INVENTION

1. Field of the Invention

In the field of high speed impact printing, driving and reversing of the inking ribbon at a controlled velocity and tension is a fundamental requirement. Drum printers are frequently employed when printing speeds of from 200 to 1000 lines per minute are required, in which systems, a ribbon is reversibly transferred between two spools and is interposed between a bank of hammers and a rotating drum of characters. The instantaneous high perpendicular forces produced upon the ribbon by the hammers and the rotating drum during printing cause the ribbon to wear, to gradually lose its ink supply, to track improperly, and ultimately to fail. By maintaining ribbon tension and velocity of travel between the spools as constant as practicable, ribbon life is prolonged as wear and ink use is distributed substantially evenly along the ribbon. Variations in ribbon tension and velocity occur primarily as a result of the changing radii of the ribbon as it winds and unwinds on the spools, which causes constantly changing spool rotational speeds and constantly changing driving motor velocity and torque requirements.

Impact printers operating at speeds of up to 300 to 400 lines per minute employ "tab" ribbons, the typical dimensions of which may be 36 yards by three inches, while higher speed printers typically employ "towel" ribbons which may be 36 yards by 1 foot. The present invention permits the more economical tab ribbons to be used at printing speeds which therefore required the more expensive and cumbersome towel ribbon, and accordingly is described in the preferred embodiment in the context of a tab ribbon system. However, the present invention is also applicable to impact printers of the type in which towel ribbons are used.

2. Description of the Prior Art

Various motor control systems have been used in the prior art to obtain constant tension and speed in transferring and winding material from a take-up reel to a supply reel in which radii of the reels typically vary by a factor of three to one or more. Without compensation for the effect produced by the changing spool radius, gearmotor-torquemotor systems of the prior art result in variation in ribbon speed and ribbon tension of as great as five to one. Prior art attempts to regulate ribbon speed and tension employ extensive servomechanisms and other complex and expensive circuitry and mechanical guides. Effective motor compensation and relatively uniform ribbon tension and speed is provided by the present invention without the complex control servomechanisms and other means of the prior art.

A constant tension-constant speed drive is disclosed by U.S. Pat. No. 3,501,682, in which a two motor system provides constant speed and tension by driving the take-up and supply reel motors in opposite directions to exert an opposing torque on one motor by the counter EMF developed across the field windings of the other motor. Another dual motor control system of the prior art in which winding and unwinding motors are driven in the same direction is disclosed by U.S. Pat. No. 3,079,538, in which the motor velocity and torque are controlled by variation of the motor field winding currents. Yet another plural motor tension and speed control for a magnetic tape drive is disclosed by U.S. Pat. No. 3,295,032, in which motor control is achieved by the use of a servomechanism. Another dual motor control is disclosed by U.S. Pat. No. 3,704,401, in which an error signal is derived from the back EMF of the motors to control a servomechanism which varies the motor speeds. Another dual motor control system of the prior art is disclosed by U.S. Pat. No. 3,715,641, in which the excitation windings of a pair of reel driving motors are oppositely energized to move the reels in opposite directions with the excitation current sum being maintained constant.

Summary of the Invention

The present invention relates to a dual motor control system and web material transport mechanism in which a pair of motors are controlled interdependently to bidirectionally drive a pair of reels while maintaining substantially uniform velocity and tension in the web material transferred therebetween. More particularly, a pair of motors are excited in series to rotate in the same direction, with each motor being mechanically coupled to a separate reel upon which web material is wound and unwound. A switching circuit provides simultaneous excitation voltage control to the motors such that the system speed is determined by one motor while the system torque is determined by the other motor. The counterelectromotive potential of the torque determinative motor is applied in series with the excitation voltage to the speed determinative motor such that both motor speed and system torque are continuously varied in accordance with the instantaneous radii of web material on the reels to maintain the web tension and velocity within a predetermined range. While the invention is applicable to any web material transportable between two driven reels or spools, such as tab and towel ribbons in impact printers and magnetic tape in tape transport systems, the invention is described in the context of a tab ribbon system utilized by an impact printer. Improved uniformity in ribbon tension and velocity is achieved without the use of complicated prior art servomechanisms, transducers, complex mechanical arrangements or complex circuitry.

It is therefore an object of the present invention to provide an improved web transport system in which substantial uniformity of tension and velocity of web material is maintained as it is bidirectionally transferred between a pair of spools.

Another object of the invention is to provide a dual motor control system in which motor torque and speed are interdependently controlled by exciting the motors in the same direction and varying the excitation voltage of one motor by adding thereto the back EMF of the other motor, which back EMF is continuously varied.

Another object of the invention is to provide a bidirectional ribbon drive and transport apparatus for use in an impact printer in which uniform ribbon tension and speed are maintained thereby increasing the useful life of the ribbon.

Yet another object of the invention is to provide a bidirectional control circuit for maintaining excitation voltages across a pair of series connected motors and for reversing the polarity of said excitation voltages at predetermined intervals such that the counter electromotive force of each motor is alternately and additively combined with the excitation voltage applied to the other motor to control the speed thereof.

Further objects and advantages of the invention will become apparent from the following detailed description taken together with the drawings wherein:

Description of the Preferred Embodiment

Figure 1:
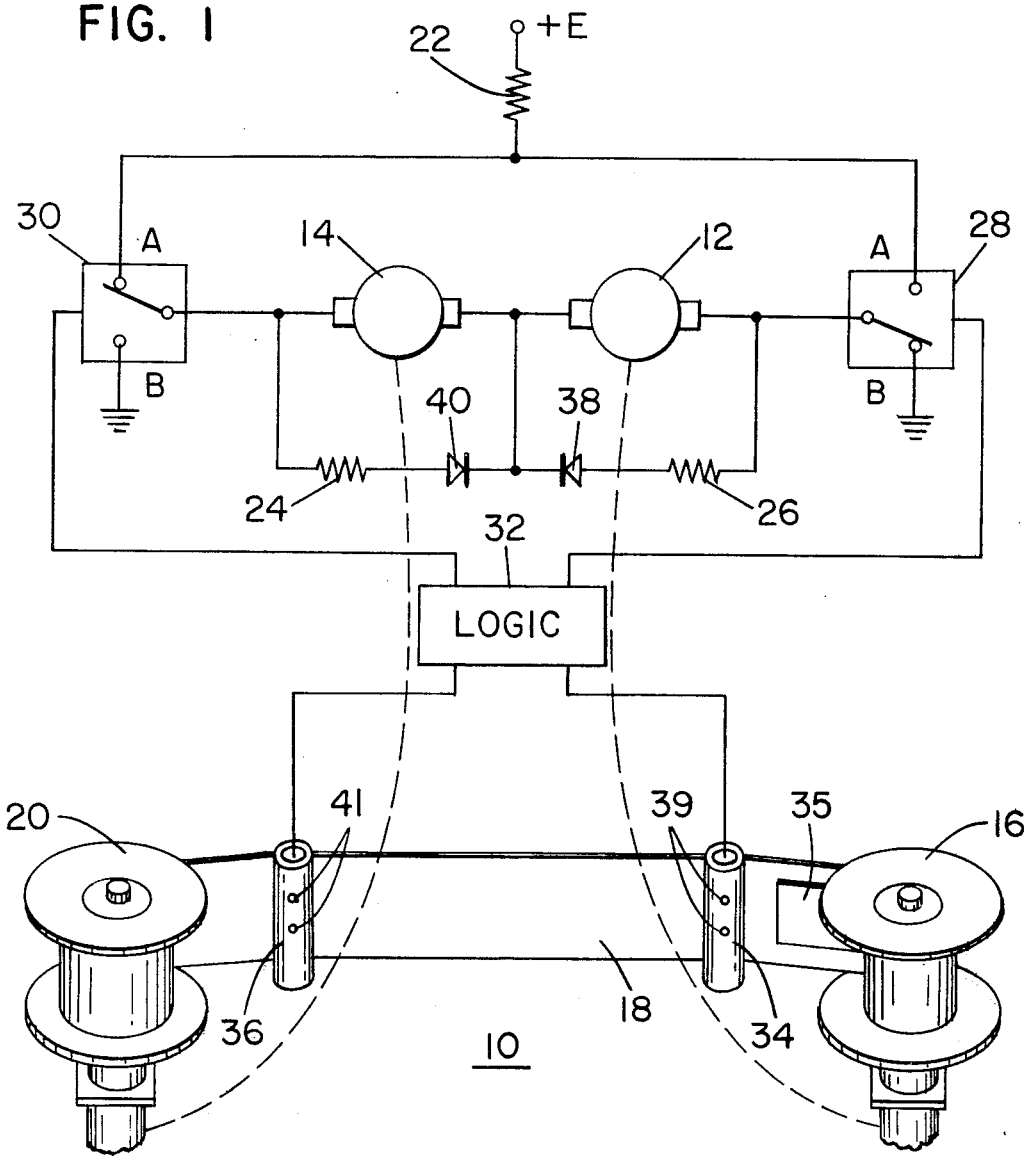
FIG. 1 is a simplified circuit and mechanical diagram illustrating the preferred embodiment of the invention.

Referring now to FIG. 1, a web transport system embodying the present invention is shown generally at 10 wherein a pair of spools are rotatably driven by a pair of motors to transfer an inking medium therebetween in an impact printer. It is well known that when a takeup reel is driven at a constant angular velocity, the linear velocity of material wound on the take-up reel from a supply reel will increase as the diameter of the take-up reel increases. Correspondingly, when a ribbon or other material is transferred to a take-up reel from a supply reel at a constant linear velocity, the angular velocity of the take-up reel is: initially greater than that of the supply reel; equal to that of the supply reel when the amount of transferred material is equal; and becomes lower than the angular velocity of the supply reel when more than half of the material is transferred, with the magnitude of the difference in reel velocities being dependent upon the magnitude of the instantaneous difference in reel diameters. Typically, in dual motor impact printer ribbon drive systems, one motor is a gearmotor which, for example, when rotating clockwise, winds ribbon on its associated spool. When such a gearmotor is rotating counterclockwise, ribbon is played off the gearmotor spool and wound on the spool associated with the other motor, which is a torque motor. The direction of travel and the velocity of the ribbon is controlled by the gearmotor, while the tension in the ribbon is maintained by the torque motor. Without compensation for the above described variations in reel angular velocity, the linear ribbon velocity will vary over a wide range, with the ratio of highest ribbon velocity to lowest ribbon velocity being typically approximately three to one. The ribbon tension will vary by an even greater margin, dependent upon the ratio of maximum and minimum spool radii, typically by about five to one, which results in ribbon folding, uneven wear and early failure at the ribbon ends where the lowest tension and velocity occur.

Figure 2A:
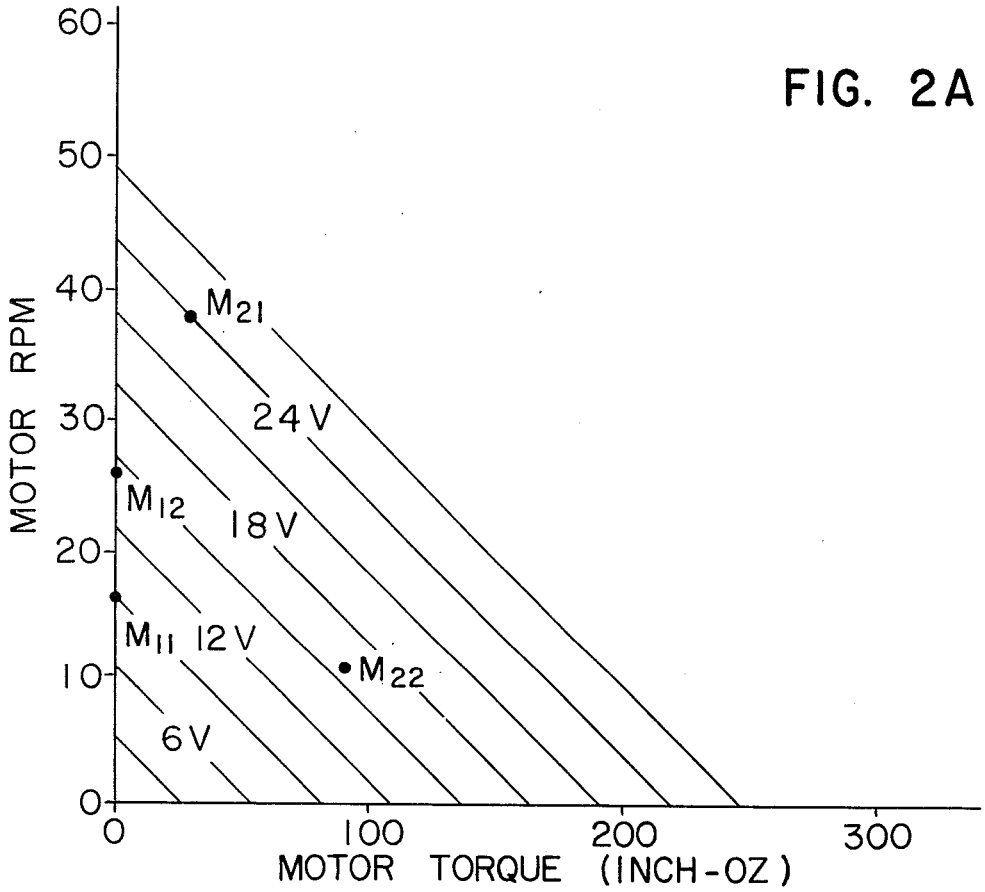
FIGS. 2A and 2B are a series of speed-torque characteristic curves and motor operating points descriptive of the invention.
Figure 2B:
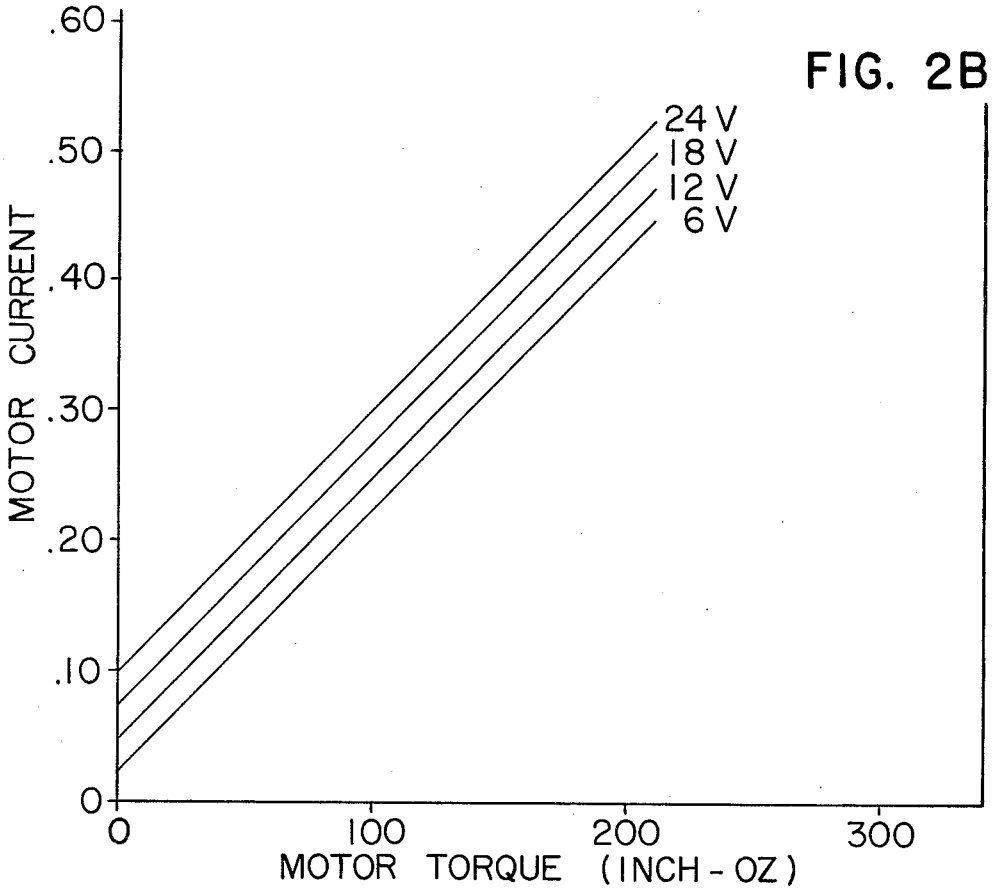

In accordance with the present invention, two motors are series connected in a bridge switch configuration, with each motor bypassed with a resistor-diode network, and excited so that both motor shafts rotate in the same direction when a driving voltage is applied. While the invention is not limited to any particular type of motor, motors 12 and 14 are preferably DC permanent magnet gearmotors having three stages of planetary gearing, of the type manufactured by Globe Industries division of TRW, part number 317A118-11, and to which motors the speedtorque curves of FIGS. 2A and 2B are applicable. When take-up spool 16, which is mechanically coupled to motor 12 is empty and taking up ribbon 18, spool 20, which is mechanically coupled to motor 14, is full and paying out ribbon. As the radii of spools 16 and 20 increase and decrease respectively, the speed and torque requirements of motors 12 and 14 will vary approximately threefold with a standard ribbon. When the motors are series connected to rotate in the same direction, due to the exciting voltages across the armatures thereof, the counter electromotive potential of motor 12 tends to compensate the speed of motor 14 while the speed of motor 14 adjusts the torque of motor 12 in an interdependent fashion and vice versa when switches 28 and 30 are actuated to reverse the direction of rotation of motors 12 and 14. The above described compensation is achieved by variation of the motor speed-torque characteristics, as will be described, when the sum of the voltages across the two motors equals the input voltage E provided across an input resistance 22. This variation is accomplished by uniquely varying the driving voltages across the armatures of motors 12 and 14 such that the excitation voltage applied to the torque producing motor is always greater than the excitation voltage applied to the speed determining motor.

When spool 16 is winding ribbon from spool 20, resistor 26 is out of the circuit due to the blocking action of diode 38, and resistor 24 is chosen such that motor 12 will have a greater voltage across its armature than will motor 14. This acts to speed up motor 12 to cause it to attempt to take up ribbon at a higher rate than motor 14 will permit, due to its lower speed. Because the gearing is chosen to be high (typically 150 to 1) and because gearboxes with large ratios are difficult to drive in the forward direction due to differences in efficiency between forward and reverse drive, the torque developed by motor 12 is insufficient to appreciably accelerate motor 14 in the forward direction. Hence, motor 14 does not appreciably increase in speed, its speed being primarily determined by its applied exciting voltage and no load characteristic, but the ribbon tension is increased. Thus, it is apparent that motor 14 is the ribbon speed determining motor while motor 12 is the torque determining motor, with its speed being determined by motor 14 and the ratio of the instantaneous radii of ribbon on spools 16 and 20, together with its own speed-torque characteristics. As the radius of ribbon on spool 16 increases, the speed of motor 12 decreases and the back EMF of motor 12 decreases, causing the torque of motor 12 to increase inversely to the rate of the increasing radius of spool 16. The decreasing back EMF of motor 12 increases the net excitation voltage applied across the armature of motor 14 thereby increasing the speed of motor 14. Thus, the decreasing speed of motor 12 tends to maintain nearly constant ribbon tension while the increasing voltage across motor 14 maintains nearly constant ribbon velocity, which, as will be explained, may be determined by a judicious choice of motor speed-torque characteristics, gearing ratios and series and parallel resistors. In this regard, DC permanent magnet motors are particularly desirable because of their linear characteristics.

Figure 3:
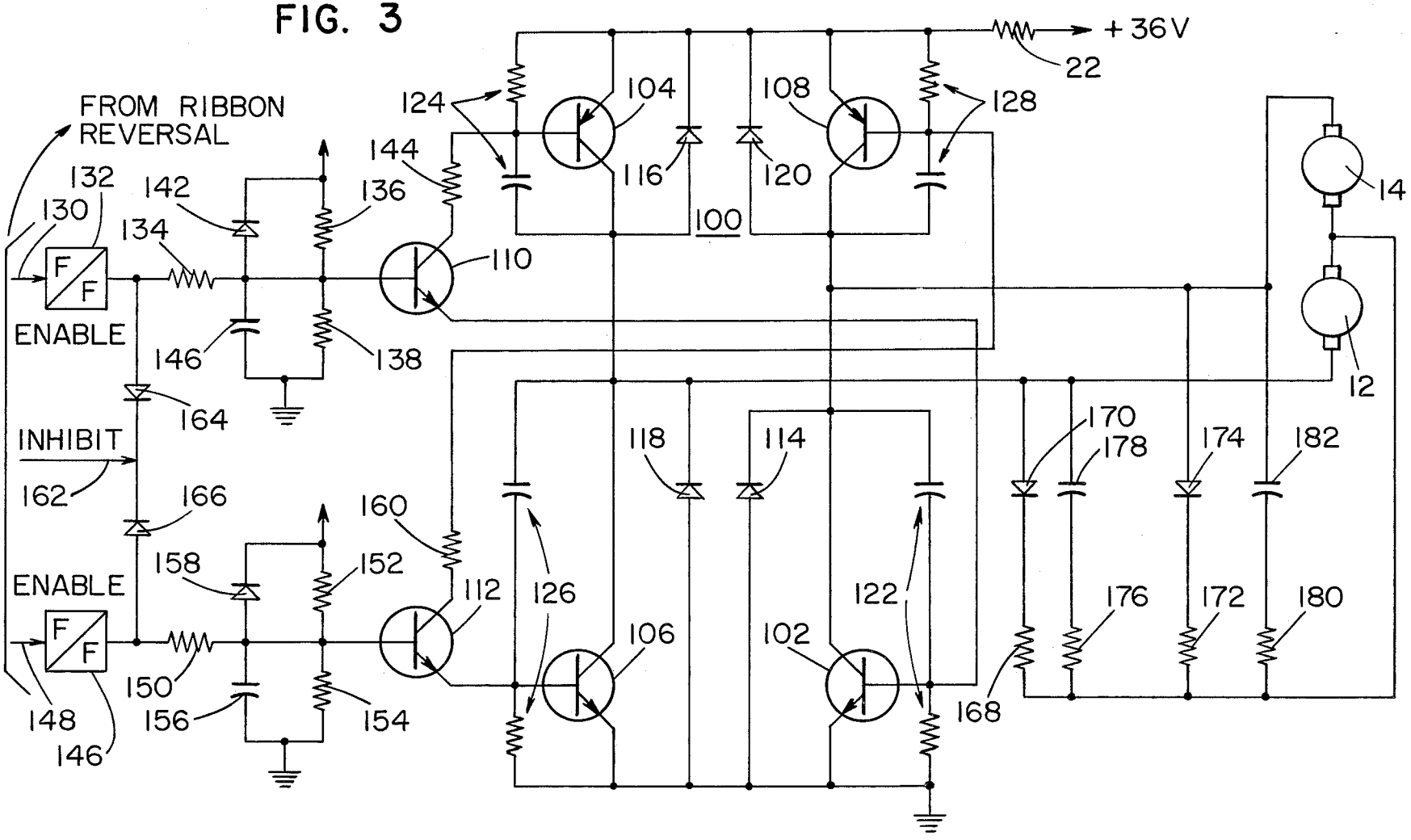
FIG. 3 is a circuit diagram of the logic and motor direction switching circuitry of the present invention.

Motors 12 and 14 are bidirectionally operable to enable ribbon 18 to be wound in either direction, with bidirectional control achieved by motor current reversal via a pair of switches 28 and 30 of the latching type, which are actuated by control signals derived from switching logic circuitry 32, which is described more completely with reference to FIG. 3. As the ribbon 18 becomes nearly fully wound on either reel 16 or reel 20, a metal foil strip such as strip 35 located near each end of the ribbon short circuits a pair of contacts such as contacts 39 on guide post 34 or contacts 41 on guide post 36 to enable the logic circuitry 32 in a well known manner.

When switch 28 is in position B and switch 30 is in position A, current from the power supply flows through resistor 22, through motors 12 and 14 and through parallel resistor 24 and diode 40. The polarity of diode 38 blocks current from flowing through parallel resistor 26. Similarly, when switch 28 is in the A position and switch 30 in the B position, current flows through both motors 12 and 14 and through the loop which includes parallel resistor 26 and diode 38, but is blocked by diode 40 from flowing through resistor 24. Thus, the simultaneous actuation in a latching manner of switches 28 and 30 provides bidirectional operation of the motors 12 and 14, which are alternately torque determinative and speed determinative, by alternately inserting a voltage divider network across either motor 12 or motor 14.

The operation of the motor control system of FIG. 1 will now be explained in detail with reference to the characteristic speed-torque curves of FIGS. 2A and 2B which correspond to permanent magnet motors 12 and 14. When switch 28 is in the B position and switch 30 is in the A position, motor 14 is bypassed by parallel resistor 24 and accordingly has less voltage across the armature thereof than does motor 12, which is not bypassed by resistor 26 due to the blocking effect of diode 38. Accordingly, motor 12 will attempt to run at a higher speed than will motor 14 as it is excited by a higher voltage, and motor 12 will attempt to pull motor 14 in the forward direction as it is mechanically coupled thereto by the ribbon 18. Thus, as previously described, motor 14 determines the speed of the two motors since the motor gearing prevents one motor from appreciatively mechanically increasing the speed of the other, and motor 12 is determinative of the system torque. The less excited motor 14 is effectively operating at no load due to the mechanical isolation provided by its associated gearbox. The voltage across each motor is $$E = iR + Kv\ (RPM)$$

where R is the armature resistance, Kv is the motor voltage constant and Kv (RPM) is the motor back EMF. It is at once apparent that the back EMF of motor 12 acts to reduce the actual exciting voltage across motor 14. The velocity of motor 14 is dependent only upon its exciting voltage, due to the lack of sufficient torque by motor 12 to appreciably increase the speed of motor 14; hence, motor 14 operates on the no-load portion of the curve of FIG. 2A and motor 12 slows to some point on the load curve at which its speed is held by motor 14.

Assuming now that switch 30 is at position B and switch 28 is at position A, that motor 12 is bypassed by resistor 26 and a motor 12 speed of 16 RPM, a torque constant Kv of 0.46, a full spool 16 with a diameter of 3.3 inches and an empty spool 20 with a diameter of 1.4 inches; then at 16 RPM on the no load line, point $M_{11}$, the starting point for motor 12 shows approximately 9 volts. Since the spool tangential velocity $\omega R$, which is also the ribbon velocity, is proportional to the spool radii, $$RPM = \frac{\omega}{R},$$

the speed of motor 14 is calculated as follows: Motor 12 Ribbon Velocity = (16 RPM)

$$\text{Motor 12 Ribbon Velocity} = (16\ \text{RPM})\left(\frac{3.3\pi}{60}\right) = 2.76\ \text{in/sec.}$$

Motor 14 speed = 2.76 in/sec $$\text{Motor 14 speed} = 2.76\ \text{in/sec}\left(\frac{60}{1.4\pi}\right) = 37.7\ \text{RPM.}$$

From the curve, it can be seen that with 24 volts across motor 14, at approximately 38 RPM, the starting point $M_{21}$ of motor 2 is located on the 24 volt line.

As the instantaneous radii of the spools change, the speed of motor 14 decreases and the speed of motor 12 increases, with a tendency toward compensation, since the back EMF (KvRPM) also decreases with decreasing speed. When the ribbon is fully wound on spool 20, the motor 12 end point $M_{12}$ on the no-load curve does not reach 38 RPM, but rather only 26 RPM, since motor 12 exciting voltage is reduced by the back EMF of motor 14. Correspondingly, motor 14 starts at 38 RPM and decreases in speed to 11 RPM while the torque of motor 14 varies from 28 oz/in torque at $M_{21}$ to 92 oz/in torque at the motor 14 end point $M_{22}$. At the ribbon reversal point, switch 30 is moved to the A position and switch 28 to the B position, which causes motors 12 and 14 to reverse roles, e.g. point $M_{11}$ becomes the starting point for motor 14 and point $M_{21}$ becomes the starting point for motor 12.

The above variation in motor torque is highly desirable in that it maintains the ribbon tension reasonably uniform, as will now be explained. As the ribbon is wound past guideposts 34 and 36, friction inherent in the guideposts reduces the tension according to the relationship $$T = T_o e^{\mu}$$

where:

$T$ = actual ribbon tension $T_o$ = ribbon tension without guidepost $\mu$ = coefficient of friction between ribbon and guidepost (typically 0.25)

$\theta$ = angle of wrap of ribbon around the guidepost (typically 1.31 radians)

if $T_{in} = T_{out}\ e.25(1.31) = 0.74\ T_{out}$, then using the torque values obtained from FIG. 2:

$$T = \frac{\text{torque}}{\text{radius}} \times \text{loss} = \frac{(28)}{1.41}(2)(.74) = 29.3\ o_z \text{ at point } M_{21}$$

$$T = \frac{\text{torque}}{\text{radius}} \times \text{loss} = \frac{92}{3.3}(2)(.74) = 41.3 o_z \text{at point } M_{22}$$

The percentage variation in tension at the motor end points where the difference in spool radius is greatest is approximately 33% versus several hundred percent in systems of the prior art.

FIG. 2B illustrates the motor armature current of motors 12 and 14 at various exciting voltages and the resultant motor speeds and torque produced, and is included as illustrative of the current values possible with the particular selected motors. Of course, other motors would have other motor characteristics, and the particular motor selected should have an operating range suitable for the desired task.

Specific desired operating points may be obtained by "shaping" the characteristic curves of FIGS. 2A and 2B by varying the input resistance 22. However, the fundamental speed and torque compensation is achieved directly from the motor operation, i.e., the constantly changing spool radius of one motor changes the speed of that motor, which changes its back EMF ($K_rRPM$), which in turn either increases or reduces the excitation voltage applied to the other motor (operating on the no-load curve), thereby increasing or decreasing the speed of the other motor. Since the speed of the no-load motor also determines the speed of the first mentioned motor, its speed also varies interdependently with the speed of the no-load motor. The overall effect is to achieve a speed-torque operating range of both motors which, in conjunction with the varying spool radii, results in a more uniform ribbon tension and ribbon velocity than has heretofore been possible in systems of the prior art, and without the complex control means of the prior art.

Referring now to FIG. 3, ribbon reversing logic 32 and bridge switches 28 and 30 are illustrated. As previously discussed, motors 12 and 14 are always excited in the same direction until the applied excitation voltages are reversed in response to a signal derived from the logic circuitry 32. This occurs when the metal foil strips 35 at either end of the ribbon 18 contact switches on either guidepost 34 or 36. Two pairs of transistors comprise switches 28 and 30, with one pair switching current flow in one direction and the other pair switching current flow in the opposite direction. Bridge or H switch 100 is comprised of a first pair of switching transistors 102 and 104 and a second pair of switching transistors 106 and 108. When spool 16 coupled to motor 12 is winding, switches 28 and 30 are in the positions illustrated in FIG. 1 and transistors 106 and 108 are conductive while transistors 102 and 104 are nonconductive. Upon receipt of control voltages from the forward and reverse transistor drivers 110 and 112, respectively, transistor pair 106 and 108 are switched nonconductive while transistor pair 102 and 104 become conductive, thereby flipping switches 28 and 30 to their opposite positions. The normal transistor switch standby condition is OFF until transistor switch 102-104 is driven ON by forward driver 110 or transistor switch 106-108 is driven ON by reverse driver 112. Alternate current paths are thus provided for the DC supply voltage E which is coupled to the switch 100 through a power dissipating resistor 22. Protective diodes 114, 116, 118 and 120 provide current paths across the transistors 102, 104, 106, and 108, respectively, when current is switched OFF. Noise suppression during motor current reversal is provided by filter network 122 for transistor 102, filter network 124 for transistor 104, filter network 126 for transistor 106 and by filter network 128 for transistor 108. The ribbon foil contact switches 39 and 41 on the guideposts 34 and 36 enable a plurality of logic signals from a memory or other circuitry of well known design, such as a flip-flop for generating logic 0 or logic 1 levels. By way of example, a logic enable signal for enabling the motors 12 and 14 in a clockwise or forward direction is coupled via line 130 to flip-flop 132, which couples the signal through coupling resistor 134 and a noise supression filter network comprising resistors 136 and 138, capacitor 140, and diode 142 to the base of the forward driver transistor 110, which turns ON the switch comprising transistors 102 and 104. Current drive between driver 110 and the transistor switch is provided by a resistor 144.

Flip-flop 146 is enabled in a manner identical to flip-flop 132 with a motor reverse enabling signal generated in response to the ribbon reaching an end contact strip 35, which signal is coupled thereto via line 148. When a motor reverse enabling signal is coupled to the base of reverse driver transistor 112 through coupling resistor 150 and a noise suppression filter network comprised of resistors 152 and 154, capacitor 156 and diode 158, the forward motor enabling signal is removed from line 130 turning OFF flip-flop 132 and removing the voltage from the base of forward driver transistor 110, thereby turning off the forward transistor switch 102–104. Switch 106–108 is turned ON after a delay determined by resistor 152, and capacitor 156, by the voltage coupled from reverse driver 112 thereto through a power resistor 160 to reverse the direction of motors 12 and 14 to rotate counterclockwise. Flip-flops 132 and 136 are mutually excusively enabled so that when flip-flop 132 is ON, flip-flop 146 is OFF and vice versa. An exception to this occurs when, for some reason, it is desired to stop motors 12 and 14 altogether, in which case an inhibit signal is coupled from the ribbon reversal logic via line 162 to a pair of inhibiting diodes 164 and 166 which negates any signal applied to the inputs of forward and reverse drivers 110 and 112.

Parallel resistor 168 and blocking diode 170 of FIG. 3 across the armature of motor 12 correspond to resistor 26 and diode 38 of FIG. 1 and operate to alter the excitation voltage applied to motor 12 as described with reference to FIG. 1. Similarly, parallel resistor 172 and blocking diode 174 of FIG. 3 across the armature of motor 14 correspond to resistor 24 and diode 40 of FIG. 1 and operate to alter the excitation voltage applied to motor 14 as described with reference to FIG. 1. Noise and transient suppression during current switching is provided across motor 12 by a noise suppression network comprising resistor 176 and capacitor 178 and across motor 14 by a noise suppression network comprising resistor 180 and capacitor 182.

While the invention has been shown and described with reference to the preferred embodiment thereof, it will be understood that persons skilled in the art may make modifications thereof without departing from the spirit and scope of the invention as defined by the claims appended hereto.

What is claimed is:

1. A bidirectional web material transport system comprising:

first and second electric motors electrically excited in series to rotate in the same direction, one of said motors being torque producing and the other speed determinative;

first and second reels mechanically coupled to said first and second motors respectively for transferring web material therebetween;

circuit means for applying excitation voltages to said motors;

coupling means for coupling the back EMF of said first motor additively with the excitation voltage applied to said second motor to vary the total excitation voltage applied to said second motor in accordance with the instantaneous ratio of the radii of web material on said first and second reels and to maintain a greater total excitation voltage on said torque producing motor than on said speed determinative motor; and switching means for reversing the excitation voltages applied to said first and second motors when a predetermined length of web material is transferred from one of said reels to the other of said reels such that said motors are caused to reverse their direction of rotation and such that the back EMF of said second motor is additively combined with the excitation voltage applied to said first motor in accordance with the instantaneous ratio of the radii of web material on said first and second reels, and such that the excitation voltage applied to said torque producing motor increases with increasing load and decreasing speed.

2. A bidirectional web material transport system in accordance with claim 1 wherein said first and second motors are DC permanent magnet motors.

3. A bidirectional web material transport system in accordance with claim 1 wherein said circuit means for applying excitation voltages to said first and second motors includes first and second voltage divider networks respectively.

4. A bidirectional web material transport system in accordance with claim 3 wherein said first voltage divider network reduces the excitation voltage applied to said first motor when web material is transferred from said first reel to said second reel and wherein said second voltage divider network reduces the excitation voltage applied to said second motor when web material is transferred from said second reel to said first reel.

5. A bidirectional web material transport system in accordance with claim 4 wherein said first voltage divider network includes a resistance and diode series connected to each other and in parallel with said first motor and said second voltage divider network includes a resistance and diode connected in series with each other and in parallel with said second motor.

6. A bidirectional web transport system in accordance with claim 5 wherein the speed of rotation of said first motor is substantially determined by the excitation voltage applied thereto during the transfer of web material from said first reel to said second reel and wherein the speed of rotation of said second motor is substantially determined by the excitation voltage applied thereto during the transfer of web material from said second reel to said first reel.

7. A bidirectional web transport system in accordance with claim 6 further comprising:

a first gearing means mechanically coupled between said first motor and said first reel; and a second gearing means mechanically coupled between said second motor and said second reel, said first and second gearing means being of sufficient ratio to substantially prevent said first motor from increasing the speed of said second motor during transfer of web material from said first reel to said second reel and substantially prevent said second motor from increasing the speed of said first motor during transfer of web material from said second reel to said first reel.

8. A bidirectional web transport system in accordance with claim 5 wherein said first and second voltage divider networks are connected across the armatures of said first and second motors, respectively, and wherein said switching means is a bridge switch for simultaneously removing said first voltage divider network from across the armature of said first motor when said second voltage divider network is inserted across the armature of said second motor and for simultaneously removing said second voltage divider network from across the armature of said second motor when said first voltage divider network is inserted across the armature of said first motor.

9. A bidirectional web transport system in accordance with claim 8 wherein said web material comprises an inked ribbon having metal foil contacts near either and thereof, and further including:

a pair of ribbon guideposts, each of which guideposts includes a switch actuable by contact with said metal foil; and logic means for generating a logic signal in response to actuation of either of said guidepost switches for switching said switching means.

10. A bidirectional ribbon transport apparatus for maintaining uniform speed and tension of a flexible ribbon wound on a pair of storage reels and transferred therebetween, comprising:

first and second electric motors having first and second excitation windings, respectively, electrically connected in series such that one of said motors is torque determinative and the other of said motors is speed determinative;

first and second storage reels rotatably mechanically coupled to said first and second electric motors, respectively;

an excitation voltage source for supplying excitation voltages to said first and second excitation windings for exciting said first and second motors for rotation in the same direction;

a voltage divider network for causing greater excitation voltage to be applied to the excitation windings of said first motor when said motor is torque determinative than is applied to said second motor;

said switching means for simultaneously reversing the polarity and magnitude of the excitation voltages applied to said first and second motor, such that said torque determinative motor becomes speed determinative and said speed determinative motor becomes torque determinative.

11. A bidirectional ribbon transport apparatus in accordance with claim 10 wherein the excitation voltage supplied to the excitation windings of said second motor is decreased in magnitude by the counter electromotive force developed by said first motor when ribbon is transferred from said second storage reel to said first storage reel and wherein the excitation voltage supplied to the excitation windings of said first motor is decreased in magnitude by the counter electromotive force developed by said second motor when ribbon is transferred from said first storage reel to said second storage reel such that variations in the speed of and torque generated by said first and second motors caused by variation of the radii of said first and second reels of ribbon during transport operates to maintain substantial uniformity of ribbon tension and speed.

12. A bidirectional ribbon transport apparatus in accordance with claim 11 wherein said first and second electric motors are DC motors.

13. A bidirectional ribbon transport apparatus in accordance with claim 11 wherein said first and second electric motors are DC permanent magnet motors.

14. A bidirectional ribbon transport apparatus in accordance with claim 13 wherein said voltage divider network comprises a first resistance and a first diode connected in parallel with the armature of said first motor and a second resistance and a second diode connected in parallel with the armature of said second motor.

15. A bidirectional ribbon transport apparatus in accordance with claim 14 wherein said switching means is capable of alternately assuming either of two stable states such that:

in said first stable state said first resistance and said first diode are coupled across the armature of said first motor, said second resistance and said second diode are decoupled from across the armature of said motor, and ribbon is transported from said first reel to said second reel; and in said second stable state said first resistance and said first diode are decoupled from across the armature of said first motor, said second resistance and said second diode are coupled across the armature of said second motor, and ribbon is transported from said second reel to said first reel.

16. A system for bidirectionally transporting web material between storage reels upon which said web material is wound such that the tension and velocity of transport of said web material between said storage reels is controllably varied between predetermined limits, comprising:

first and second electric motors connected in series to each other and to a source of excitation voltage for rotation in the same direction;

first and second storage reels rotatably coupled to said first and second motors, respectively;

means for generating a control signal;

switching means for alternately reversing the polarity of said excitation voltage in response to said control signal to reverse the direction of rotation of said motors; and means for reducing the excitation voltage applied to said first motor and increasing the excitation voltage applied to said second motor when said motors rotate in one direction and for increasing the excitation voltage applied to said first motor and reducing the excitation voltage applied to said second motor when said motors rotate in said reverse direction, such that the torque generated by said first and second motors and the speed of rotation of said first and second motors varies to compensate for changes in the radii of web material on said first and second reels by increasing the excitation voltage across the torque producing motor with increasing load and decreasing speed and maintaining the tension in said web material and the speed of transport thereof between said predetermined limits.

17. A system in accordance with claim 16 wherein the armatures of said first and second motors are electrically connected such that the counter electromotive voltage generated by said first motor is instantaneously summed with the excitation voltage applied to said second motor to decrease the speed of said second motor when web material is transported from said first reel to said second reel, and such that the counter electromotive voltage generated by said second motor is instantaneously summed with the excitation voltage applied to said first motor to decrease the speed of said first motor when web material is transported from said second reel to said first reel.

18. A system in accordance with claim 17 wherein said first and second motors are DC motors.

19. A system in accordance with claim 17 wherein said first and second motors are DC permanent magnet motors.

20. A system in accordance with claim 19 further comprising:

first and second gearing mechanisms interposed between said first motor and said first reel and said second motor and said second reel respectively for preventing either said first motor from mechanically increasing the speed of said second motor or said second motor from mechanically increasing the speed of said first motor.

21. A system in accordance with claim 20 wherein said means for reducing the excitation voltage comprises a first impedance in parallel with said first motor and a second impedance in parallel with said second motor and a first blocking diode in series with said first impedance and a second blocking diode in series with said second impedance such that current of one polarity will flow through said first impedance and will be blocked from flowing through said second impedance while current of reverse polarity will flow through said second impedance and will be blocked from flowing through said first impedance.

22. A system in accordance with claim 20 wherein said means for reducing the excitation voltage comprises a voltage divider circuit switchably connected across the armatures of said first and second motors by said switching means.

23. A system in accordance with claim 22 wherein said switching means comprises a bridge switch.

24. A system in accordance with claim 22 wherein said means for generating said control signal includes means for sensing a first predetermined location on said ribbon when said first location is unwound from said first reel and means for sensing a second predetermined location on said ribbon when said second location is unwound from said second reel.

* * * * *